US009515403B2

(12) United States Patent
Hirakawa et al.

(10) Patent No.: US 9,515,403 B2
(45) Date of Patent: Dec. 6, 2016

(54) FEMALE TERMINAL ASSEMBLY

(71) Applicant: YAZAKI CORPORATION, Tokyo (JP)

(72) Inventors: Takayoshi Hirakawa, Shizuoka (JP); Hidehiko Kuboshima, Shizuoka (JP); Toshikazu Yoshioka, Shizuoka (JP); Yuya Yamada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/982,895

(22) Filed: Dec. 29, 2015

(65) Prior Publication Data

US 2016/0134044 A1 May 12, 2016

Related U.S. Application Data

(63) Continuation of application No. PCT/JP2014/067274, filed on Jun. 27, 2014.

(30) Foreign Application Priority Data

Jul. 5, 2013 (JP) ..... 2013-141883
Oct. 7, 2013 (JP) ..... 2013-210435

(51) Int. Cl.
*H01R 13/187* (2006.01)
*H01R 4/18* (2006.01)
(Continued)

(52) U.S. Cl.
CPC ..... *H01R 13/187* (2013.01); *H01R 4/184* (2013.01); *H01R 13/506* (2013.01); *H01R 4/4881* (2013.01)

(58) Field of Classification Search
CPC ... H01R 13/187; H01R 13/113; H01R 13/111; H01R 43/16; H01R 13/184
(Continued)

(56) References Cited

U.S. PATENT DOCUMENTS 4,657,335 A * 4/1987 Koch ..... H01R 13/187 439/851
4,934,965 A * 6/1990 Buddrus ..... H01R 13/113 439/845
(Continued)

FOREIGN PATENT DOCUMENTS

JP 62-271374 A 11/1987
JP 2000-91013 A 3/2000
(Continued)

OTHER PUBLICATIONS

International Search Report and Written Opinion of the International Search Report for PCT/JP2014/067274 dated Jul. 29, 2014.
(Continued)

*Primary Examiner* — Briggitte R Hammond
(74) *Attorney, Agent, or Firm* — Kenealy & Vaidya LLP

(57) ABSTRACT

A female terminal assembly includes: a female terminal body in which a male terminal receiving space is formed internally; and a cylindrical spring contact which is received in the male terminal receiving space from a male terminal insertion side of the female terminal body. A lock portion formed at a male terminal insertion-side end portion of the spring contact is fixed to a male terminal insertion-side end portion of the female terminal body.

5 Claims, 10 Drawing Sheets

(51) Int. Cl.
*H01R 13/506* (2006.01)
*H01R 4/48* (2006.01)

(58) Field of Classification Search
USPC ..... 439/843, 846
See application file for complete search history.

(56) References Cited

U.S. PATENT DOCUMENTS 5,433,630 A * 7/1995 Inaba ..... H01R 13/187 439/287
5,474,479 A * 12/1995 Bennett ..... H01R 13/187 439/843
6,042,432 A * 3/2000 Hashizawa ..... H01R 13/187 439/843
6,254,439 B1 * 7/2001 Endo ..... H01R 13/187 439/843
6,848,922 B2 * 2/2005 Coughlan ..... H01R 13/53 439/181
6,899,571 B1 * 5/2005 Koch ..... H01R 4/4881 439/843
8,784,143 B2 * 7/2014 Edgell ..... A61N 1/3752 439/246
2002/0187686 A1 * 12/2002 Zhao ..... H01R 13/187 439/843
2003/0060090 A1 * 3/2003 Allgood ..... H01R 11/289 439/845
2003/0068931 A1 4/2003 Swearingen et al.
2004/0003498 A1 * 1/2004 Swearingen ..... H01R 13/187 29/862
2009/0298356 A1 * 12/2009 Li ..... H01R 13/187 439/843
2012/0315802 A1 * 12/2012 Blakborn ..... H01R 13/113 439/700

FOREIGN PATENT DOCUMENTS

JP 2002-100430 A 4/2002
JP 3498832 B2 2/2004
JP 2005-510038 A 4/2005

OTHER PUBLICATIONS

English language Written Opinion of the International Search Report for PCT/JP2014/067274 dated Jul. 29, 2014.

* cited by examiner

FEMALE TERMINAL ASSEMBLY

CROSS REFERENCE TO RELATED APPLICATIONS

This application is a continuation of PCT application No. PCT/JP2014/067274, which was filed on Jun. 27, 2014 based on Japanese Patent Application (No. 2013-141883) filed on Jul. 5, 2013 and Japanese Patent Application (No. 2013-210435) filed on Oct. 7, 2013, the contents of which are incorporated herein by reference.

BACKGROUND OF THE INVENTION

1. Field of the Invention

The present invention relates to a female terminal assembly of a connector housing used for connection etc. between a battery of an electric car and various equipments. Particularly, it relates to a female terminal assembly for large current, in which a cylindrical spring contact making contact with a mating male terminal is provided inside a terminal body.

2. Description of the Related Art

A female terminal assembly described in Japanese Patent No. 3498832 is provided as one of female terminal assemblies for large current according to the background art. FIG. 9(A) is a perspective view of the female terminal assembly described in Japanese Patent No. 3498832. FIG. 9(B) is a longitudinal sectional view along an axial direction of the female terminal assembly in FIG. 9(A). FIG. 10(A) is an exploded perspective view of the female terminal assembly in FIG. 9(A). FIG. 10(B) is a longitudinal sectional view of a spring portion which explains an insertion force in the female terminal assembly in FIG. 9(A).

In FIG. 9(A), the female terminal assembly 100 includes a female terminal body 110, a resin cap 120, and a spring contact 130. The female terminal body 110 and the spring contact 130 are formed as metal plates punched out respectively. The female terminal body 110 is rounded and formed into a circular cylindrical shape by press working. The resin cap 120 is injection-molded out of a synthetic resin.

The female terminal body 110, the resin cap 120, and the spring contact 130 will be described below simply.

<Female Terminal Body 110>

The female terminal body 110 is substantially shaped like a circular cylindrical shape as a whole. In FIG. 9(B) and FIG. 10(A), a resin cap retaining portion 110A, a spring receiving portion 110B, a spring stopper 110C, a convex portion 110D, and a crimping portion 110K are formed in the named order from a front end side (male terminal side: left side in FIG. 9(B) and FIG. 10(A)).

<<Resin Cap Retaining Portion 110A>>

The resin cap retaining portion 110A is formed at a forefront end of the female terminal body 110 and has an inner diameter larger than a maximum outer diameter of the spring contact 130. An outer circumference of the resin cap retaining portion 110A which protrudes outward serves as a lock protrusion which is engaged with a lock claw formed on an inner side of the resin cap 120.

<<Spring Receiving Portion 110B>>

The spring receiving portion 110B has an inner diameter approximately equal to the maximum outer diameter of the spring contact 130. The spring contact 130 is received in the spring receiving portion 110B.

<<Spring Stopper 110C>>

The spring stopper 110C has an inner diameter smaller than the maximum outer diameter of the spring contact 130.

An end face of the spring stopper 110C is brought into abutment against a connection portion 130R of the spring contact 130 received in the spring receiving portion 110B, to thereby restrict the spring contact 130 from moving rearward (toward the crimping portion 110K). Thus, the terminal can be prevented from slipping off rearward.

<<Convex Portion 110D>>

The convex portion 110D is formed circumferentially in a body portion of the female terminal body 110, and has an outer diameter approximately equal to an outer diameter of the resin cap 120. Thus, an inner diameter of a terminal receiving chamber of a connector housing where the female terminal assembly 100 can be received is made approximately equal to the outer diameter of the resin cap 120. In this manner, when the female terminal assembly 100 is received in the terminal receiving chamber of the connector housing, the convex portion 110D of the female terminal body 110 is brought into pressure contact with an inner circumferential surface of the terminal receiving chamber to thereby prevent the female terminal assembly 100 from leaning or rattling.

<<Crimping Portion 110K>>

Prior to crimping, the crimping portion 110K has a U-shape in front view. A core wire of a cable is placed in a bottom portion of the U-shape, and opposite end portions of the U-shape are crimped inward relatively to each other by a jig. In this manner, the cable can be crimped to the crimp portion 110K, and the cable and the female terminal body 110 can be electrically connected to each other.

<Resin Cap 120>

In FIG. 9(B), the resin cap 120 mainly includes an introduction port 120G, a stopper wall 120S and an outer wall 120W which are integrally molded out of a synthetic resin.

<<Introduction Port 120G>>

The introduction port 120G has a diameter which is approximately equal to that of a male terminal. After the resin cap 120 is attached to the front end of the female terminal body 110, the male terminal is inserted into the female terminal body 110 through the introduction port 120G.

<<Stopper Wall 120S>>

The stopper wall 120S is formed to be continued to the introduction port 120G. The stopper wall 120S is shaped like a circular cylinder having an inner diameter which is equal to that of the introduction port 120G and an outer diameter which is approximately equal to the inner diameter of the resin cap retaining portion 110A of the female terminal body 110. When the resin cap 120 is attached to the front end of the female terminal body 110, the resin cap 120 is pressed into the resin cap retaining portion 110A of the female terminal body 110. On this occasion, an end face of the stopper wall 120S is brought into abutment against a connection portion 130R of the spring contact 130 inside the spring receiving portion 110B, to thereby restrict the spring contact 130 from moving frontward.

<<Outer Wall 120W>>

The outer wall 120W is integrally molded on an outer side of the stopper wall 120S with a gap therebetween. The width of the gap is equal to the thickness of the resin cap retaining portion 110A. The lock claw to be engaged with the lock protrusion of the female terminal body 110 is provided protrusively on a lower end of an inner circumferential face of the outer wall 120W.

<Spring Contact 130>

The spring contact 130 is formed as a metal plate which is punched into a perforated plate-like article. In the perforated plate-like article, a large number of long plate spring pieces 130L are curved inward (toward the center when the perforated plate-like article is rounded into a circular cylindrical shape) into arc shapes at their central portions. The long plate spring pieces 130L are connected to one another at their opposite end portions by the connection portions 130R and 130R respectively. In use, the spring contact 130 is rounded into a circular cylindrical shape.

<Method for Assembling Female Terminal Assembly 100>

Next, a method for assembling the female terminal assembly 100 will be described.

First, the long plate spring pieces 130L which connect opposite ends of the two connection portions 130R of the spring contact 130 with each other respectively are brought into contact with each other. The spring contact 130 is inserted into the spring receiving portion 110B of the female terminal body 110 as it is without being compressed in its diameter direction.

Then, while the stopper wall 120S of the resin cap 120 is pressed into the resin cap retaining portion 11A0 of the female terminal body 110, the resin cap 120 is attached to the front end of the female terminal body 110.

In this manner, the end face of the stopper wall 120S pressed into the resin cap retaining portion 110A of the female terminal body 110 abuts against the connection portion 130R of the spring contact 130. Thus, the spring contact 130 can be retained inside the spring receiving portion 110B.

Simultaneously with this, the lock claw of the outer wall 120W is engaged with the lock protrusion of the outer circumference of the resin cap retaining portion 110A. Thus, the resin cap 120 and the female terminal body 110 can be coupled to each other firmly.

Next, problems of the female terminal assembly 110 will be described using FIG. 10(B).

In order to receive the spring contact 130 inside the spring receiving portion 110B of the female terminal body 110, the spring stopper 110C is provided on a deep side of the spring receiving portion 110B (toward the crimping portion 110K) to prevent the spring contact 130 from moving any further deeper.

Accordingly, when a front end head portion 200S of a male terminal 200 is inserted into the female terminal assembly 100 in an insertion direction (a direction of a white arrow in FIG. 10(B)) to press the spring contact 130 as shown in FIG. 10(B), the spring contact 130 is pressed rearward. As soon as the connection portion 130R of the spring contact 130 hits against the spring stopper 110C, the spring contact 130 tends to extend back to an opposite side to the insertion direction of the male terminal (in a direction of a black arrow in FIG. 10(B)). Therefore, there is a problem that a force for inserting the terminal may increase. In this manner, the spring stopper 110C serves as a fixed point and the spring extension direction is opposite to the insertion direction. Accordingly, the force for inserting the terminal may increase to be higher.

Therefore, in the current situation, in order to reduce the insertion force, a low insertion force lever is provided in a connector to fit the male and female terminals to each other. In this manner, a worker's burden can be reduced but provision of the low insertion force lever in the connector becomes an obstacle to meeting market needs for miniaturization of the connector itself or multipolarization of the terminal.

SUMMARY OF THE INVENTION

Therefore, in order to solve the foregoing problems, an object of the invention is to provide a female terminal assembly in which an insertion force can be reduced without providing any low insertion force lever in a connector so that it is possible to contribute to miniaturization of the connector itself and further meet market needs for multipolarization of a terminal.

The aforementioned object of the invention can be achieved by the following configurations.

(1) A female terminal assembly comprising: a female terminal body in which a male terminal receiving space is formed internally; and a cylindrical spring contact which is received in the male terminal receiving space from a male terminal insertion side of the female terminal body, wherein a lock portion formed at a male terminal insertion-side end portion of the spring contact is fixed to a male terminal insertion-side end portion of the female terminal body.

(2) The female terminal assembly according to the aforementioned configuration (1), wherein the lock portion is a bent portion which is formed by bending an end portion of the spring contact outward.

(3) The female terminal assembly according to the aforementioned configuration (2), wherein a spring bent portion locking notch is formed at the end portion of the female terminal body, and the bent portion of the spring contact is locked to the spring bent portion locking notch.

(4) The female terminal assembly according to any one of the aforementioned configurations (1) to (3), wherein the cylindrical spring contact is a circular cylindrical spring contact.

(5) The female terminal assembly according to the aforementioned configuration (4), further comprising: a resin cap which is fitted to an end portion of the female terminal body, wherein the lock portion is fixed between the end portion of the female terminal body and the resin cap.

(6) The female terminal assembly according to any one of the aforementioned configurations (1) to (3), wherein the cylindrical spring contact is a rectangular cylindrical spring contact.

(7) The female terminal assembly according to the aforementioned configuration (6), wherein a slip-out stopping piece is protrusively provided in the rectangular cylindrical spring contact so that the slip-out stopping piece is fitted to a lock hole formed in the female terminal body to restrict the rectangular cylindrical spring contact from moving in a slip-out direction.

(8) The female terminal assembly according to the aforementioned configuration (7), wherein the rectangular cylindrical spring contact is formed by bending a metal plate into a rectangular cylindrical shape so that an abutment portion between end edges of the metal plate bent into the rectangular cylindrical shape is formed on one side surface side of the rectangular cylindrical spring contact, and a side wall portion having a curved shape portion is formed on the other side surface side of the rectangular cylindrical spring contact.

(9) The female terminal assembly according to the aforementioned configuration (8), wherein a side edge of a side wall piece extending from one end edge and a side edge of a side wall piece extending from the other end edge abut against each other in the abutment portion of the rectangular cylindrical spring contact, so that the abutment between the side edges of the side wall pieces restricts the side wall pieces from moving relatively to each other in a direction along an insertion direction of a male terminal.

According to the aforementioned configuration (1), when a male terminal is inserted into the female terminal assembly to press the spring contact, the spring contact extends rearward because the spring contact is free on a spring rear end side with the lock portion as a fixed point. Accordingly, a spring extension direction and an insertion direction are the same. Thus, a force for inserting the terminal tends to decrease.

According to the aforementioned configuration (2), the lock portion of the spring contact can be formed easily and firmly.

According to the aforementioned configuration (3), the spring extension direction and the insertion direction are the same. Accordingly, the force for inserting the terminal tends to decrease, and positioning of a rotation direction of the spring contact can be performed.

According to the aforementioned configuration (4), when the male terminal is inserted into the female terminal assembly to press the spring contact, the spring contact extends rearward because the spring contact is free on the spring rear end side with the lock portion as a fixed point. Accordingly, the spring extension direction and the insertion direction are the same. Thus, the force for inserting the terminal tends to decrease.

According to the aforementioned configuration (5), when the male terminal which has been inserted inside the female terminal assembly by a low insertion force is removed, the resin cap can prevent the lock portion from moving. Accordingly, there is a lance locking function inside a housing and a terminal slip-out prevention effect. Further, the spring contact is free on the spring rear end side with the lock portion as a fixed point. Accordingly, when an extraction force acts on the connected male terminal, an extraction direction and the spring extension direction are opposite to each other to thereby make it difficult to extract the male terminal. Accordingly, connection reliability is improved.

According to the aforementioned configuration (6), when a contact flat plate portion of a male terminal is inserted into the spring contact in a terminal fitting portion of the female terminal body so that the spring contact is pressed by the contact flat plate portion, the spring contact extends rearward because the spring contact is free on the spring rear end side with the lock portion as a fixed point. Accordingly, the spring extension direction and the insertion direction are the same as each other. Therefore, the force for inserting the terminal tends to decrease and it is possible to connect the male terminal to the female terminal assembly by a small insertion force.

According to the aforementioned configuration (7), when the spring contact is mounted in the terminal fitting portion of the female terminal assembly, the slip-out stopping piece provided protrusively in the spring contact is fitted into the lock hole formed in the female terminal body so that the spring contact can be prevented from slipping out of the terminal fitting portion. Therefore, even when the contact flat plate portion of the male terminal is extracted from the terminal fitting portion with the result that a force in an extraction direction acts on the spring contact, the spring contact does not slip out of the terminal fitting portion together with the male terminal. Accordingly, it is possible to easily perform an operation for inserting/removing (an operation for removing) the male terminal.

According to the aforementioned configuration (8), the abutment portion is set on the one side surface side of the spring contact. Accordingly, the spring contact has a structure in which one pair of opposing walls connected by the side wall portion having the curved shape portion are symmetric to each other. Therefore, it is possible to apply an elastic restoration force of the curved shape portion to the pair of opposing walls uniformly. Accordingly, it is possible to make an electric connection state between the spring contact and the female terminal body more stable.

According to the aforementioned configuration (9), when the contact flat plate portion of the male terminal is inserted/removed into/from the spring contact, the side wall piece extending from the one end edge and the side wall piece extending from the other end edge abut against each other in one side wall portion serving as the abutment portion of the spring contact. Accordingly, it is possible to restrict the side wall pieces from moving relatively to each other in the direction along the insertion direction of the contact flat plate portion. Thus, it is possible to prevent distortion from being generated on one side of the spring contact.

Therefore, a work for inserting/removing the contact flat plate portion of the male terminal can be prevented from being impeded by the distortion of the spring contact during insertion/removal of the contact flat plate portion. Accordingly, it is possible to easily perform the work for inserting/removing the contact flat plate portion.

According to the female terminal assembly according to the invention, the insertion force can be reduced even without providing any low insertion force lever in a connector. Accordingly, it is possible to contribute to miniaturization of the connector itself and it is possible to meet market needs for multipolarization of the terminal.

The invention has been described above briefly. Further, when a mode (hereinafter referred to as "embodiment") for carrying out the invention which will be described below is read through with reference to the accompanying drawings, details of the invention can be made further clearer.

DETAILED DESCRIPTION OF THE EXEMPLARY EMBODIMENTS

Preferred embodiments of a female terminal assembly in which an insertion force can be reduced without providing any low insertion force lever in a connector so that it is possible to contribute to miniaturization of the connector itself and further meet market needs for multipolarization of a terminal will be described below based on FIGS. 1 to 8.

First Embodiment

Female Terminal Assembly 10 According to First Embodiment of Invention

Figure 1A:
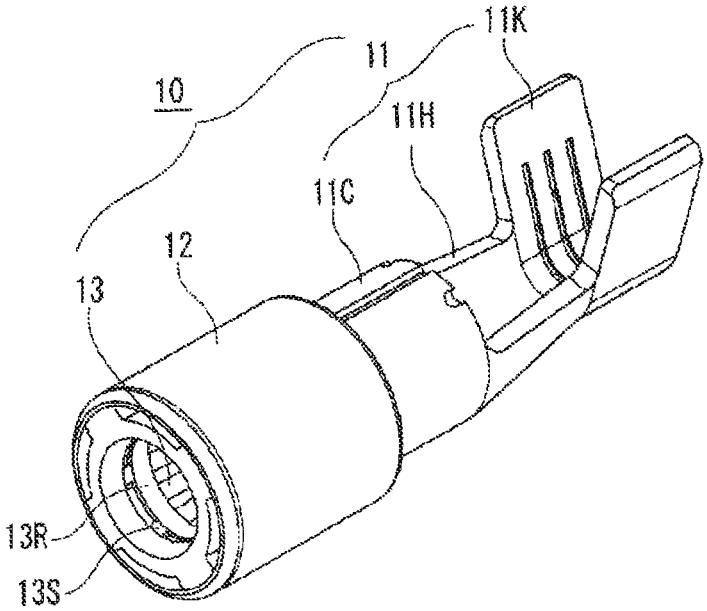
FIG. 1(A) is a perspective view of a female terminal assembly according to a first embodiment of the invention.
Figure 1B:
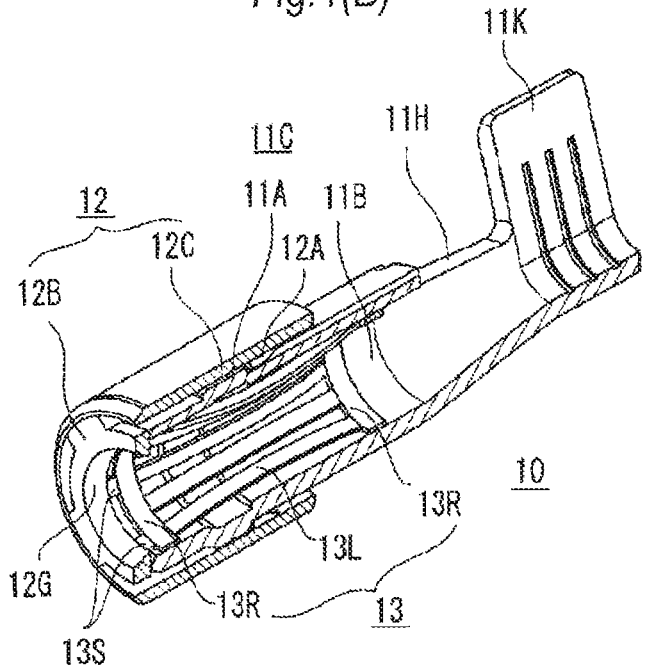
FIG. 1(B) is a longitudinal sectional view along an axial direction of the female terminal assembly in FIG. 1(A).
Figure 2A:
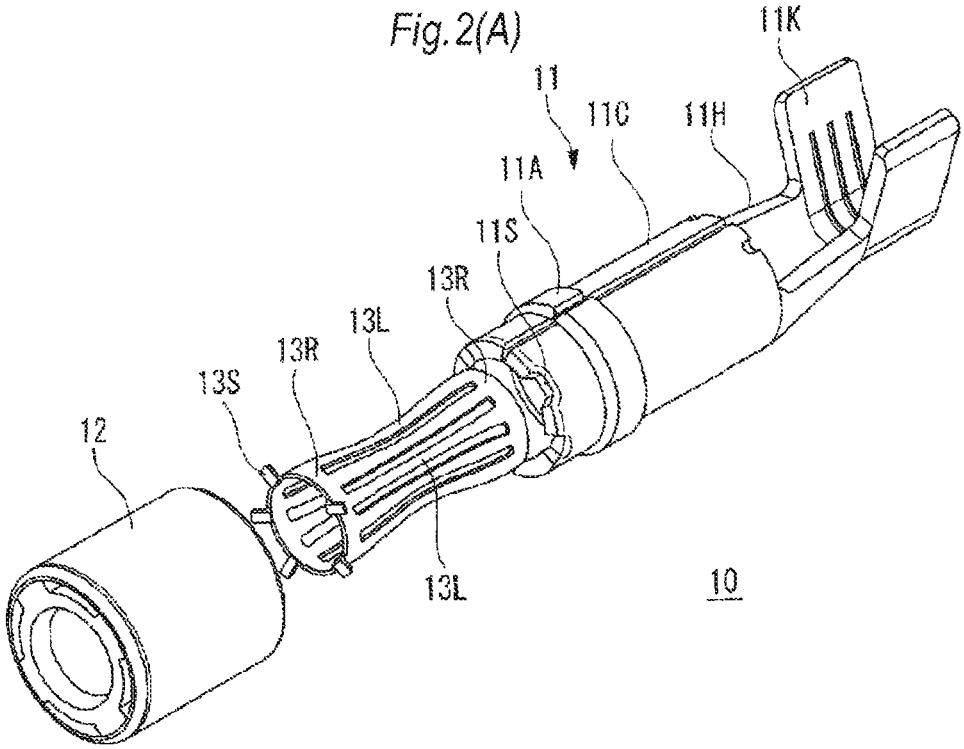
FIG. 2(A) is an exploded perspective view of the female terminal assembly in FIG. 1(A)
Figure 2B:
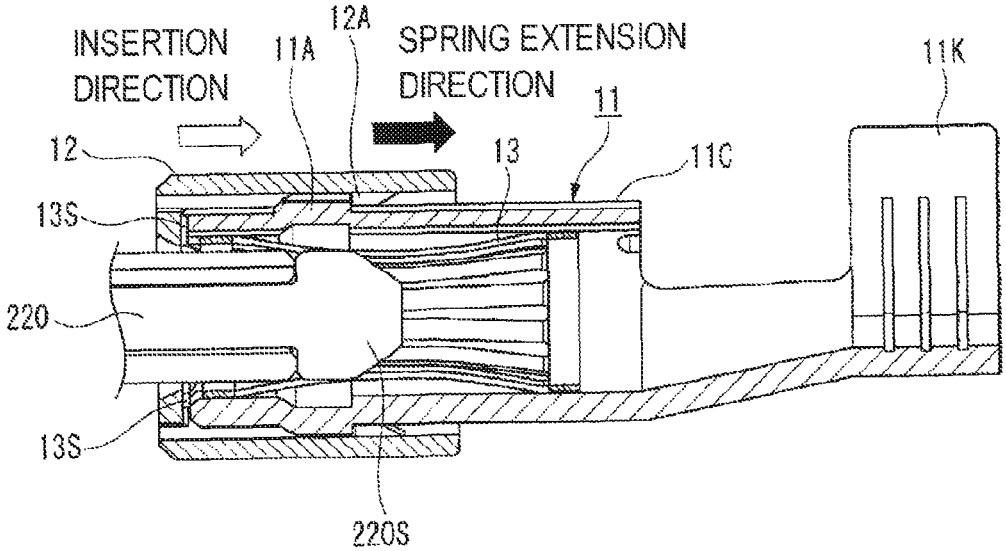
FIG. 2(B) is a longitudinal sectional view of a spring portion which explains an insertion force in the female terminal assembly in FIG. 1(A).

FIG. 1 and FIG. 2 show a first embodiment of a female terminal assembly according to the invention. FIG. 1(A) is a perspective view of the female terminal assembly according to the first embodiment of the invention. FIG. 1(B) is a longitudinal sectional view along an axial direction of the female terminal assembly in FIG. 1(A). FIG. 2(A) is an exploded perspective view of the female terminal assembly in FIG. 1(A). FIG. 2(B) is a longitudinal sectional view of a spring portion which explains reduction of an insertion force in the female terminal assembly in FIG. 1(A).

In FIG. 1(A), the female terminal assembly 10 includes a female terminal body 11, a resin cap 12, and a spring contact 13.

The female terminal body 11 and the spring contact 13 are formed as metal plates punched out respectively. The female terminal body 11 is rounded and formed into a circular cylindrical shape by press working. The resin cap 12 is injection-molded out of a synthetic resin.

The female terminal body 11, the resin cap 12, and the spring contact 13 will be described below in detail.

<Female Terminal Body 11>

In FIG. 1(A), the female terminal body 11 has a front end-side (male terminal-side: left-side in FIG. 1(A)) circular cylinder portion 11C, a rear end-side crimping portion 11K, and a semicircular cylinder portion 11H which connects the circular cylinder portion 11C and the crimping portion 11K to each other.

<<Circular Cylinder Portion 11C>>

In FIG. 1(B), (a) a spring receiving portion 11B which receives the spring contact 13 (see FIG. 2(A)) in a circular cylindrical shape is provided in an internal space of the circular cylinder portion 11C, (b) a resin cap retaining portion 11A which retains the resin cap 12 stably is provided in an outer circumference of the circular cylinder portion 11C, and (c) spring bent portion locking notches 11S (see FIG. 2(A)) which fixedly support bent portions 13S of the spring contact 13 are formed at places of male terminal-side end portions of the circular cylinder portion 11C.

<<Resin Cap Retaining Portion 11A>>

In FIG. 2(A), the resin cap retaining portion 11A is provided as an annular ring which has a predetermined thickness and which is formed with a predetermined axial width on an outer side of a section located at nearly ⅓ from the front (male terminal side) of the circular cylinder portion 11C. The resin cap 12 is fitted to the resin cap retaining portion 11A.

The axial width of the annular ring is a width which is large enough to retain the resin cap 12 on the circular cylinder portion 11C stably. The thickness of the annular ring is approximately equal to the height of a lock claw 12A (see FIG. 1(B)) formed on an inner side of the resin cap 12. A gentle taper is formed in an axially front end portion of the annular ring so that the resin cap 12 can be fitted to the annular ring easily. In addition, a vertical cliff is formed in a rear (toward the crimping portion 11K) end portion of the annular ring so that the fitted resin cap 12 cannot slip out of the annular ring easily.

<<Spring Receiving Portion 11B>>

The spring receiving portion 11B (see FIG. 1(B)) is formed into a circular cylindrical shape which receives the spring contact 13 in a circular cylindrical shape. An inner diameter of the circular cylinder of the spring receiving portion 11B is approximately equal to a maximum outer diameter of the spring contact 13. The depth of the circular cylinder of the spring receiving portion 11B is slightly longer than an overall length of the spring contact 13 in consideration of the spring contact 13 which extends when a male terminal is inserted.

<<Spring Bent Portion Locking Notch Portion 11S>>

The spring bent portion locking notch portions 11S (see FIG. 2(A)) are notches formed at the male terminal-side end portions correspondingly to the bent portions 13S (see FIG. 2(A)) of the spring contact 13 so that the bent portions 13S can be locked to the spring bent portion locking notch portions 11S respectively.

The bent portions 13S of the spring contact 13 are locked to the spring bent portion locking notch portions 11S. Thus, it is possible to obtain (a) an insertion force reduction effect in which the spring contact 13 can extend rearward (toward the crimping portion 11K) with the bent portions 13S as fixed points when the male terminal is inserted to make contact with the spring contact 13, and (b) a positioning effect in which the spring contact 13 can be prevented from rotating even when a force in a rotation direction acts on the spring contact 13.

<<Crimping Portion 11K>>

Prior to crimping, the crimping portion 11K has a U-shape in front view. A core wire of a cable is placed on a bottom portion of the U-shape, and opposite end portions of the U-shape are crimped inward relatively to each other by a jig. In this manner, the cable can be crimped to the crimping portion 11K, and the cable and the female terminal body 11 can be electrically connected to each other.

<Resin Cap 12>

The resin cap 12 (see FIG. 1(A)) is made of a synthetic resin and integrally molded into a bottomed circular cylindrical shape. An opening as an introduction port 12G for the male terminal is provided in a bottom portion 12B of the resin cap 12. A lock claw 12A is provided on an inner side of a circular cylinder portion 12C of the resin cap 12.

<<Bottom Portion 12B>>

The front-side (male terminal-side) end portion of the circular cylinder portion 11C of the female terminal body 11 abuts against the bottom portion 12B. When the bottom portion 12B and the end portion of the circular cylinder portion 11C abut against each other, the bent portions 13S of the spring contact 13 locked to the spring bent portion locking notch portions 11S are prevented from moving toward the front side (the male terminal side).

Accordingly, the bottom portion 12B has a spring slip-out prevention function during detachment of the terminal and a lance locking function inside a housing.

<<Introduction Port 12G>>

The introduction port 12G has a diameter approximately equal to that of the male terminal. After the resin cap 12 is attached to the front end of the female terminal body 11, the male terminal is inserted into the female terminal body 11 through the introduction port 12G. Since the introduction portion 12G is tapered, a front end of the male terminal can be guided into the introduction port 12G smoothly and the male terminal can be inserted into the female terminal body 11 easily.

<<Lock Claw 12A>>

The height of the lock claw 12A (see FIG. 1(B)) is approximately equal to the thickness of the annular ring serving as the resin cap retaining portion 11A (see FIG. 2(A)) of the circular cylinder portion 11C of the female terminal body 11. A gentle taper is formed in a rear-side (crimping portion 11K) end portion of the lock claw 12A so that the lock claw 12A can be fitted to the resin cap retaining portion 11A of the female terminal body 11 easily. In addition, a vertical cliff is formed in a front-side (male terminal-side) end portion of the lock claw 12A so that the fitted resin cap retaining portion 11A can be prevented from slipping out of the lock claw 12A easily.

<Spring Contact 13>

In FIG. 1(B), the spring contact 13 is formed as a metal plate which is punched into a perforated plate-like article. In the perforated plate-like article, a large number of long plate spring pieces 13L are curved gently inward (toward the center when the perforated plate-like article is rounded into a circular cylindrical shape) into arc shapes from their opposite ends toward their central portions. The long plate spring pieces 13L are connected to one another at their opposite end portions by the connection portions 13R and 13R respectively. In use, the spring contact 13 is rounded into a circular cylindrical shape (see FIG. 2(A)).

Further, end portions of the front (male terminal-side) connection portion 13R of the spring contact 13 are bent at right angles toward a radially outer side. Thus, the bent portions 13S are formed to be continued to the front (male terminal-side) connection portion 13R. The bent portions 13S are locked to the spring bent portion locking notch portions 11S (see FIG. 2(A)) formed at the male terminal-side end portions of the circular cylinder portion 11C of the female terminal body 11.

<Method for Assembling Female Terminal Assembly 10>

Next, a method for assembling the female terminal assembly 10 will be described.

First, the spring contact 13 is rounded so that the long plate spring pieces 13L which connect the opposite ends of the two connection portions 13R of the spring contact 13 with each other respectively can be brought into contact with each other. The spring contact 13 is inserted into the spring receiving portion 11B of the female terminal body 11 as it is without being compressed in its diameter direction.

Then, the resin cap 12 is inserted onto the circular cylinder portion 11C of the female terminal body 11. When the resin cap 12 is inserted further deeply, the lock claw 12A of the resin cap 12 climbs over the resin cap retaining portion 11A of the circular cylinder portion 11C due to elastic forces of the materials of the both. Thus, the resin cap 12 and the circular cylinder portion 11C are engaged with each other and the resin cap 12 is fitted to the female terminal body 11. In this manner, the bent portions 13S of the spring contact 13 received in the spring receiving portion 11B of the female terminal body 11 are locked to the spring bent portion locking notch portions 11S of the female terminal body 11 so that the bent portions 13S can be prevented from moving toward the front side (male terminal side) and the rear side (crimping portion 11K side).

<Advantage of Female Terminal Assembly 10>

Next, an advantage of the female terminal assembly 10 will be described using FIG. 2(B).

Figure 10A:
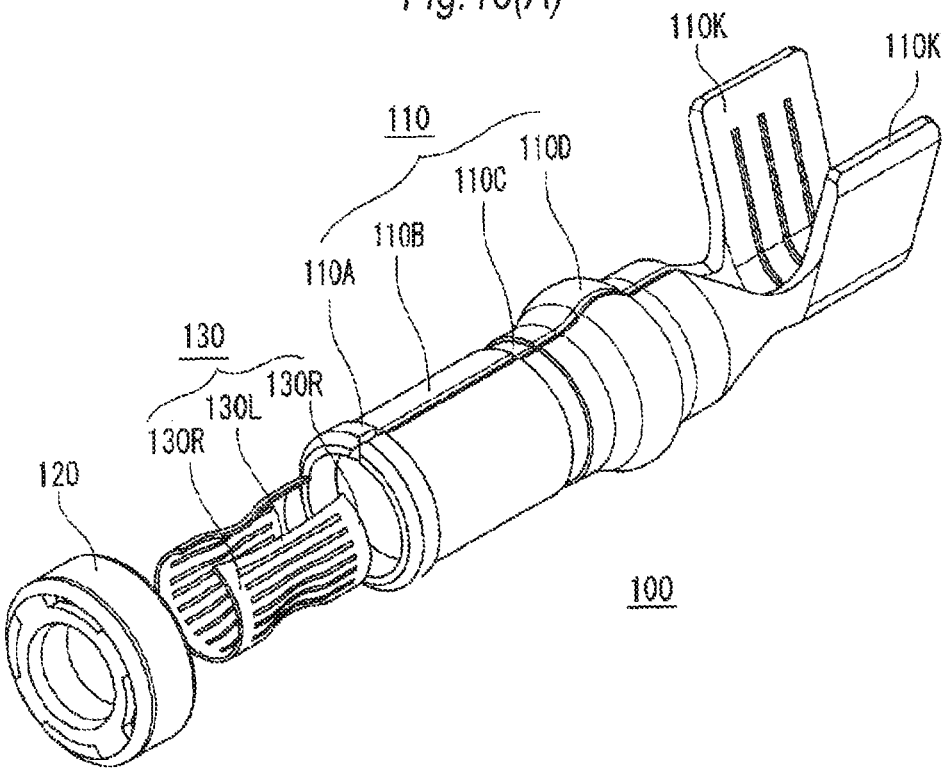
FIG. 10(A) is an exploded perspective view of the female terminal assembly in FIG. 9(A)
Figure 10B:
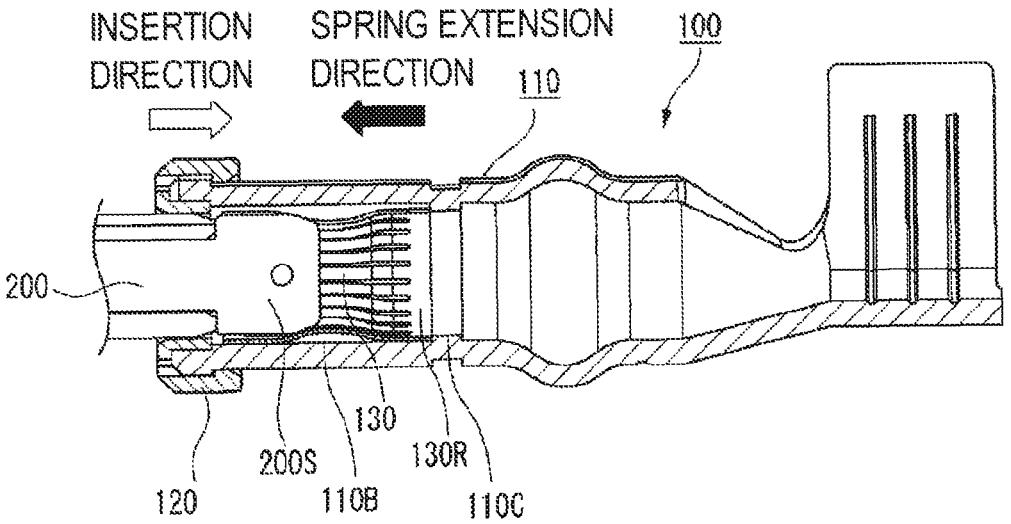
FIG. 10(B) is a longitudinal sectional view of a spring portion which explains an insertion force in the female terminal assembly in FIG. 9(A).

The plurality of bent portions 13S (see FIG. 2(A)) of the spring contact 13 are locked to the plurality of spring bent portion locking notch portions 11S (see FIG. 2(A)) formed at the front-side (male terminal-side) end portions of the female terminal body 11 respectively. Accordingly, when a front end head portion 220S of a male terminal 220 is inserted into the female terminal assembly 10 in an insertion direction (a direction of a white arrow in FIG. 2(B)) to press the spring contact 13, the spring contact 13 extends rearward (in a direction of a black arrow in FIG. 2(B)) because the spring contact 13 is free on the spring rear end side with the bent portions 13S as fixed points. Since the spring extension direction is the same as the insertion direction, a repulsive force as in the background-art type (see FIG. 10(B)) does not occur in the spring contact 13 but a force for inserting the terminal can decrease in comparison with the background art.

Accordingly, since it is unnecessary to provide a low insertion force lever in a connector, miniaturization can be attained and multipolarization, for example, increase from one pole to two poles can be attained.

Second Embodiment

Female Terminal Assembly 20 According to Second Embodiment of Invention

Figure 3A:
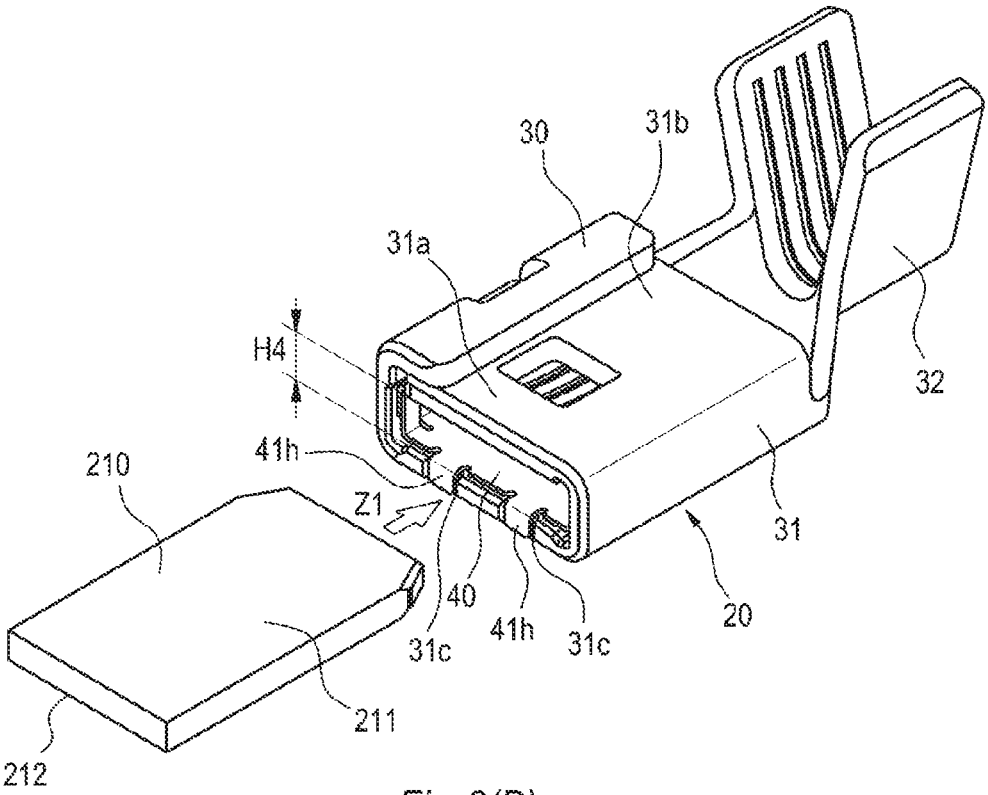
FIG. 3(A) is a perspective view of a female terminal assembly according to a second embodiment of the invention.
Figure 3B:
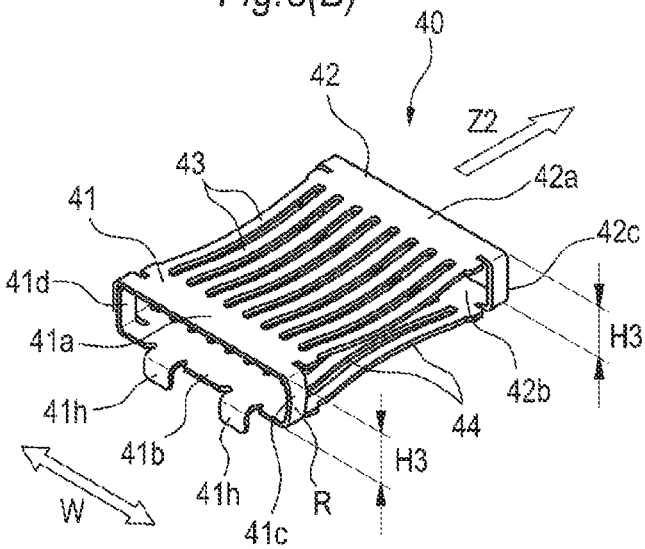
FIG. 3(B) is a perspective view of a spring contact received in a female terminal body in FIG. 3(A).
Figure 4:
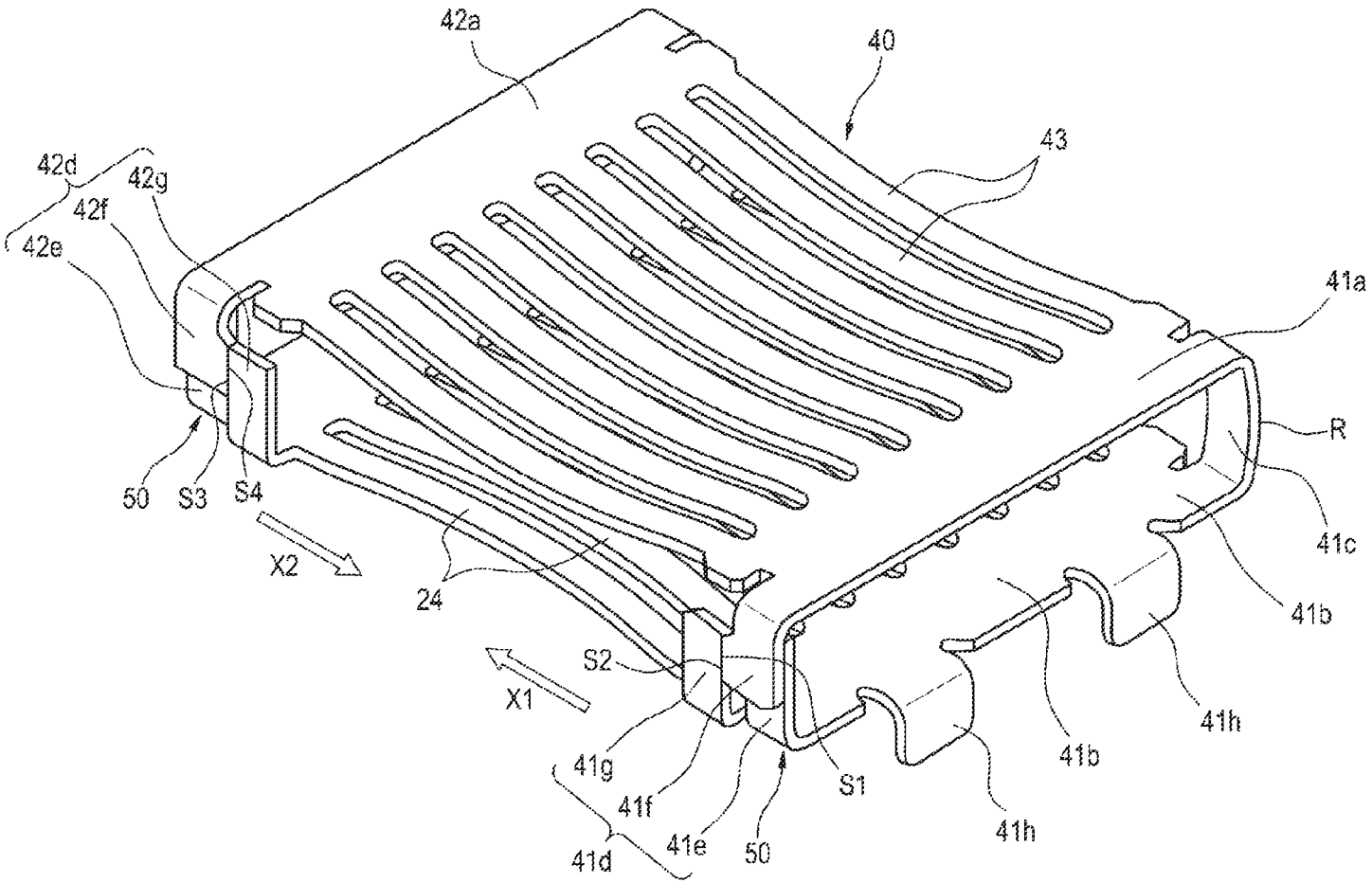
FIG. 4 is a perspective view of the spring contact shown in FIG. 3(B) when seen from another angle.
Figure 5:
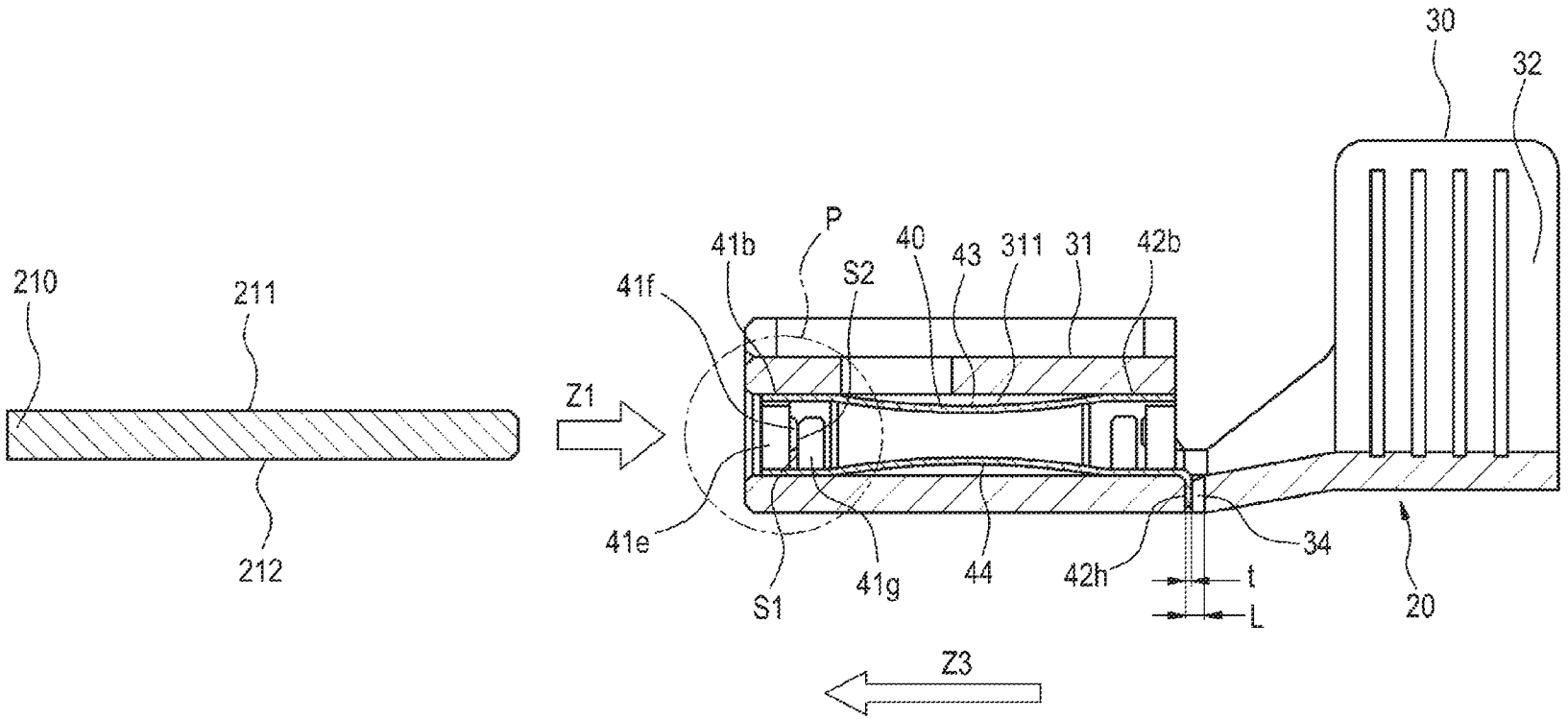
FIG. 5 is a longitudinal sectional view before a male terminal is fitted into the female terminal assembly shown in FIG. 3(A).
Figure 6:
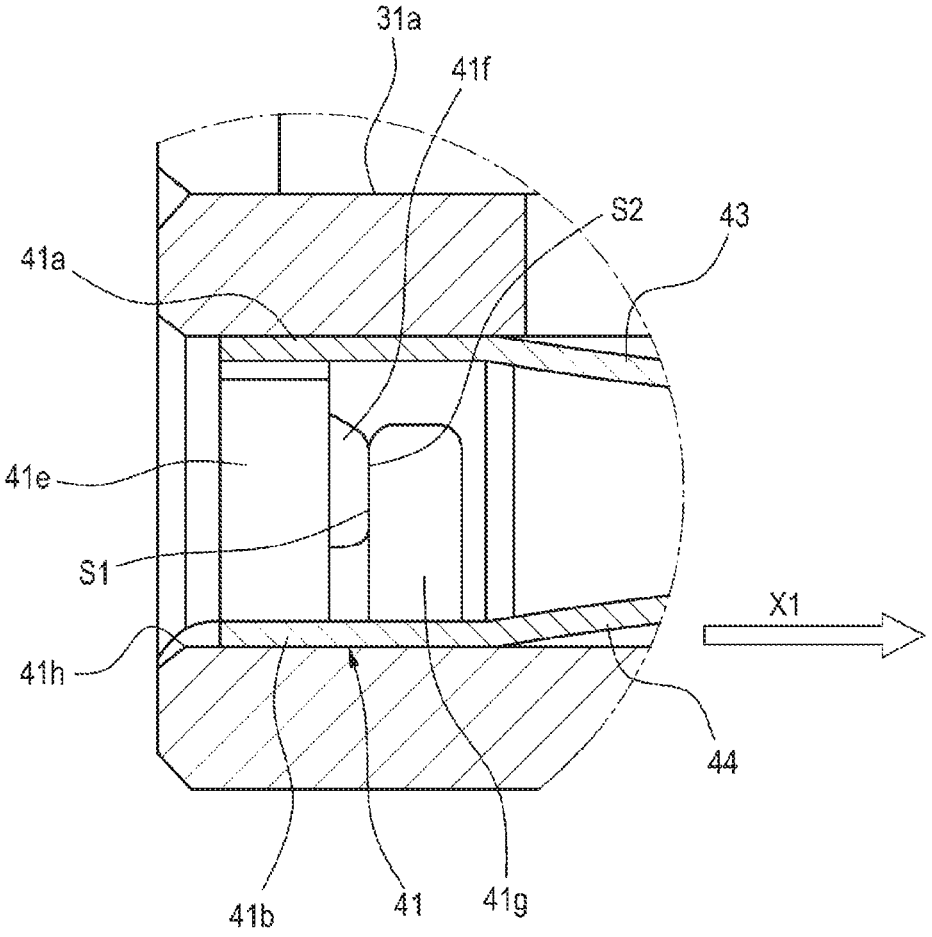
FIG. 6 is an enlarged view of a portion P in FIG. 5.
Figure 7:
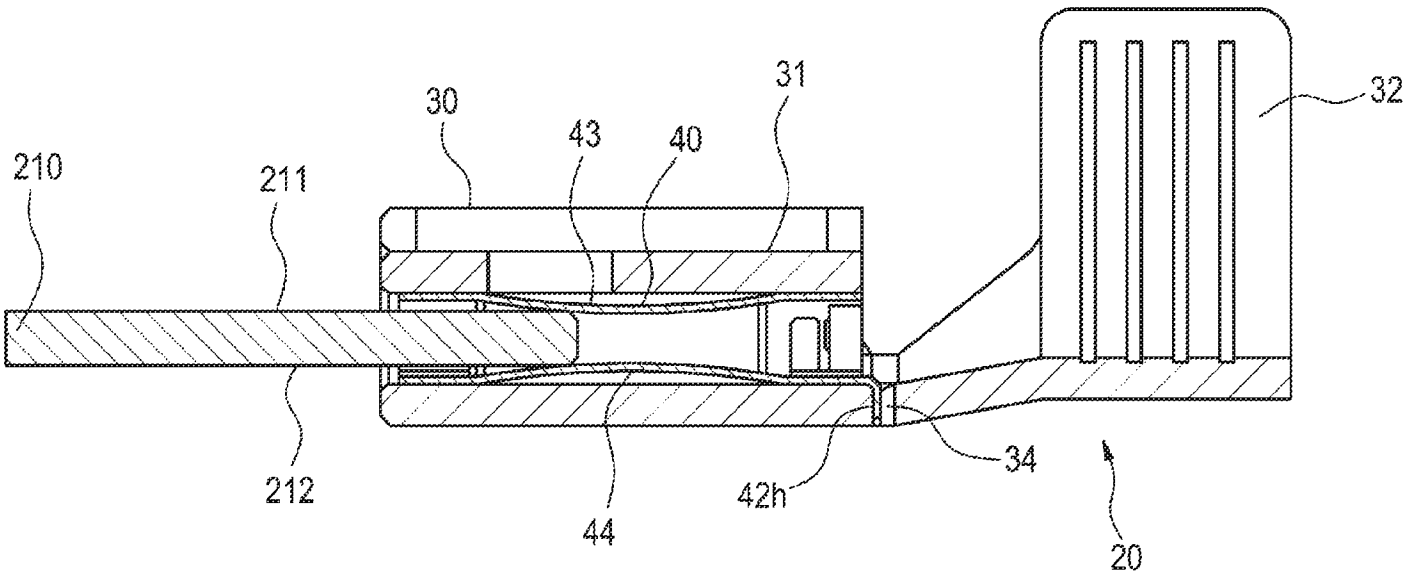
FIG. 7 is a longitudinal sectional view showing a state in which the male terminal is in the middle of being fitted into the female terminal assembly shown in FIG. 3(A).
Figure 8:
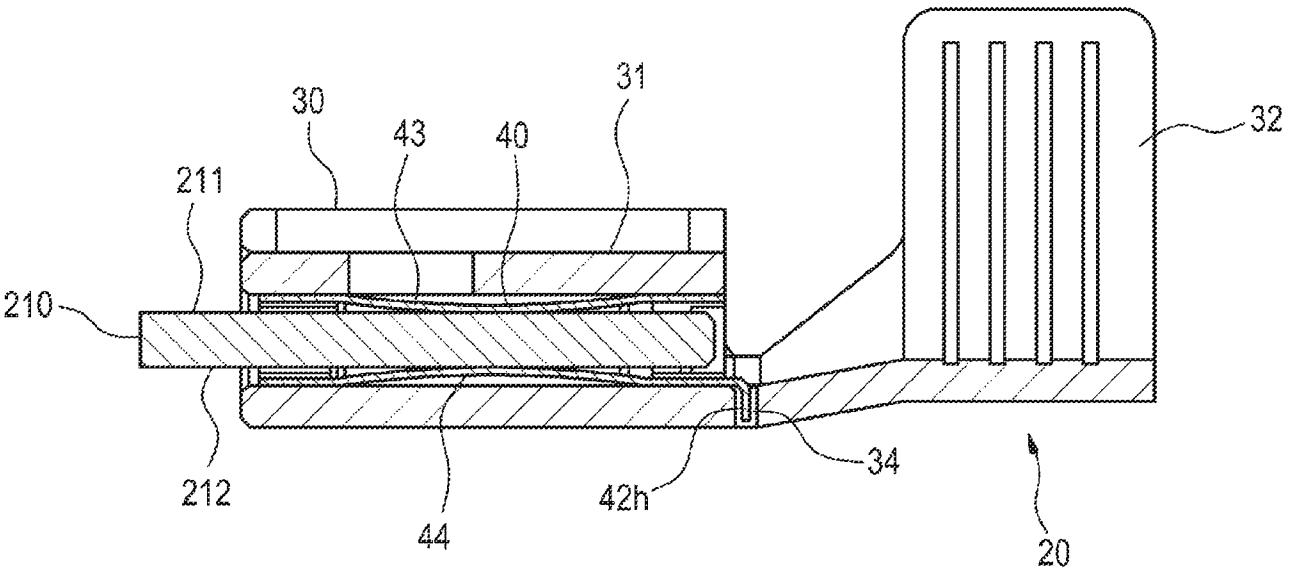
FIG. 8 is a longitudinal sectional view showing a state in which fitting of the male terminal into the female terminal assembly shown in FIG. 3(A) is completed.
Figure 9A:
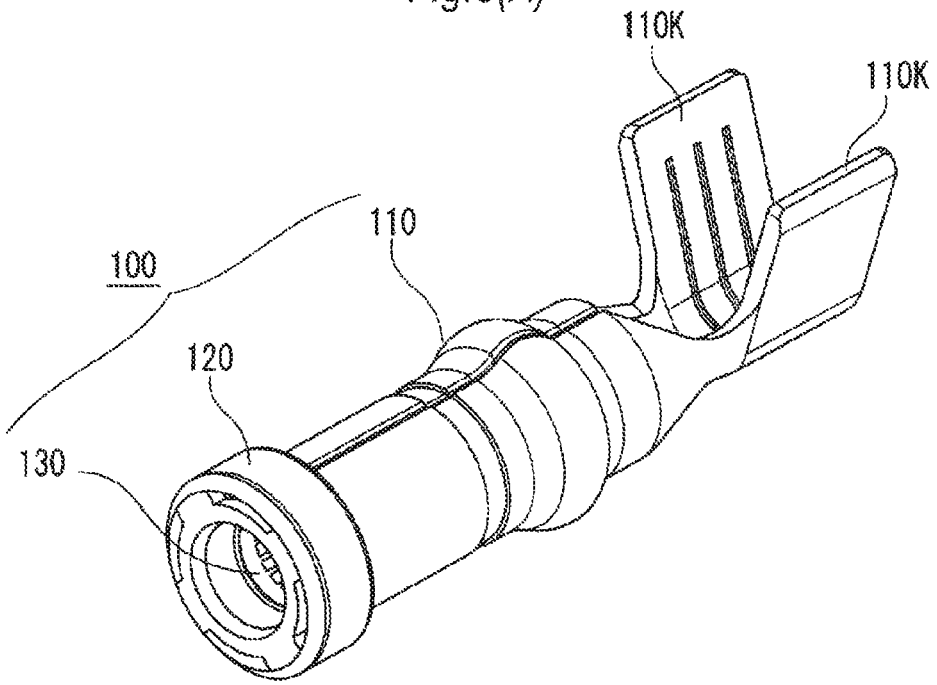
FIG. 9(A) is a perspective view of a female terminal assembly described in Japanese Patent No. 3498832.
Figure 9B:
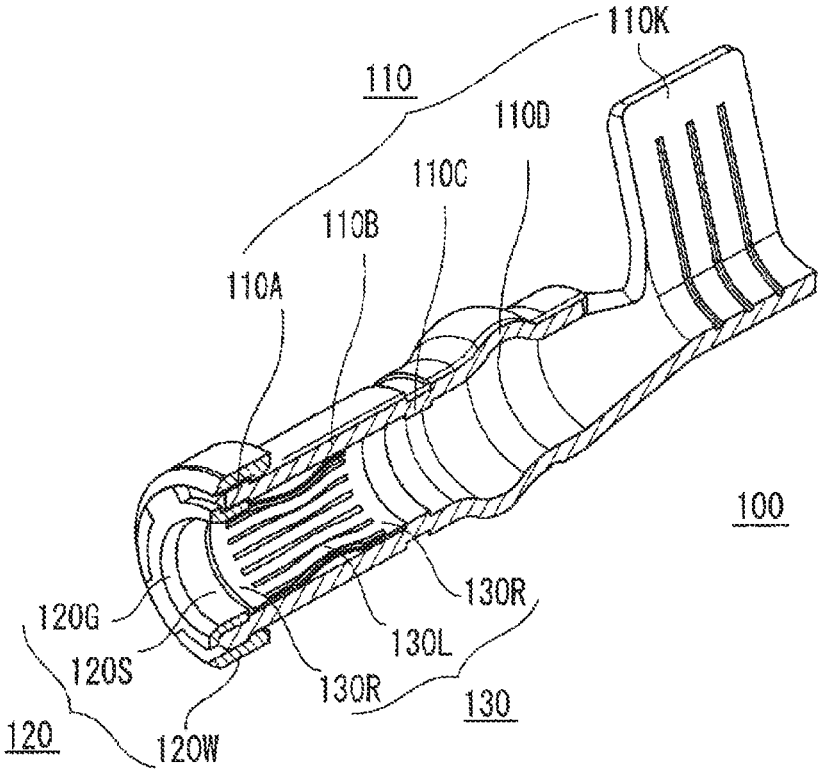
FIG. 9(B) is a longitudinal sectional view along an axial direction of the female terminal assembly in FIG. 9(A).

FIGS. 3 to 8 show a female terminal assembly according to a second embodiment of the invention. FIG. 3(A) is a perspective view of the female terminal assembly according to the second embodiment of the invention. FIG. 3(B) is a perspective view of a spring contact received in a female terminal body in FIG. 3(A). FIG. 4 is a perspective view of the spring contact shown in FIG. 3(B) when seen from another angle. FIG. 5 is a longitudinal sectional view before a male terminal is fitted into the female terminal assembly shown in FIG. 3(A). FIG. 6 is an enlarged view of a portion P in FIG. 5. FIG. 7 is a longitudinal sectional view showing a state in which the male terminal is in the middle of being fitted into the female terminal assembly shown in FIG. 3(A). FIG. 8 is a longitudinal sectional view showing a state in which fitting of the male terminal into the female terminal assembly shown in FIG. 3(A) is completed.

The female terminal assembly 20 according to the second embodiment includes a female terminal body 30 and a spring contact 40. Each of the female terminal body 30 and the spring contact 40 is a press-molded article of a metal plate. However, the spring contact 40 is formed as a metal plate thinner in plate thickness than the female terminal body 30.

The female terminal body 30 and the spring contact 40 will be described below in detail.

<Female Terminal Body 30>

As shown in FIG. 3(A), the female terminal body 30 is provided with a terminal fitting portion 31 and a cable connection portion 32. The terminal fitting portion 31 is shaped like a rectangular cylinder. A contact flat plate portion 210 of a male terminal serving as a connection partner is inserted into the terminal fitting portion 31. The cable connection portion 32 is provided to be continued to the terminal fitting portion 31. A cable is connected to the cable connection portion 32. An arrow Z1 shown in FIG. 3(A) designates an insertion direction of the contact flat plate portion 210 into the terminal fitting portion 31.

<<Terminal Fitting Portion 31>>

The terminal fitting portion 31 is provided as a metal plate which is bent and formed into a rectangular cylindrical shape having a large width. The terminal fitting portion 31 forms a male terminal receiving space 311 (see FIG. 5)

which is shaped like a rectangular cylinder. The spring contact 40 is fitted and mounted into the male terminal receiving space 311. Spring bent portion locking notches 31*c* are formed at end portions of the terminal fitting portion 31. Bent portions 41*h* of the spring contact 40 which will be described later are locked to the spring bent portion locking notches 31*c*.

<<Cable Connection Portion 32>>

The cable connection portion 32 is a section to which a cable is crimped and connected.

<Spring Contact 40>

The spring contact 40 is mounted in the terminal fitting portion 31 in a state in which the spring contact 40 is in contact with an inner surface of the terminal fitting portion 31. An arrow Z2 shown in FIG. 3(B) designates an insertion direction of the spring contact 40 into the terminal fitting portion 31.

The spring contact 40 is provided as a metal plate which is bent and formed into a rectangular cylinder. In addition, as shown in FIG. 4, according to the embodiment, abutment portions 50 between end edges of the metal plate bent into the rectangular cylindrical shape are set on one side surface (a side surface which can be seen as a near side in FIG. 4) side of the spring contact 40, and side wall portions having curved shape portions which will be described later are provided on the other side surface side of the spring contact 40. As shown in FIG. 3(B) and FIG. 4, the spring contact 40 is provided with a first frame portion 41, a second frame portion 42, first long plate spring pieces 43, and second long plate spring pieces 44.

<First Frame Portion 41>

The first frame portion 41 is formed into a tetragonal shape which internally touches a front end portion 31*a* (see FIG. 3(A)) of the terminal fitting portion 31 serving as a side from which the contact flat portion 210 is inserted (enters). As shown in FIG. 3(A), the first frame portion 41 includes a first opposing wall 41*a*, a second opposing wall 41*b*, a side wall portion 41*c* and a side wall portion 41*d* which form a tetragonal frame. The first opposing wall 41*a* is opposed to one (upper side in FIG. 3(A)) surface 211 of the contact flat plate portion 210 inserted into the terminal fitting portion 31. The second opposing wall 41*b* is opposed to the other surface 212 of the contact flat plate portion 210. The side wall portion 41*c* connects the first opposing wall 41*a* and the second opposing wall 41*b* to each other. The side wall portion 41*d* includes three side wall pieces 41*e*, 41*f* and 41*g*.

As shown in FIG. 3(B), bent portions 41*h* bent downward are provided at two widthwise-direction (a direction of an arrow W in FIG. 3(B)) separate places in a front end of the second opposing wall 41*b* of the first frame portion 41. As shown in FIG. 3(A), the bent portions 41*h* are locked to the notches 31*c* formed in the front end of the terminal fitting portion 31 so that the spring contact 40 can be restricted from moving in the insertion direction.

As shown in FIG. 4, the one side wall portion 41*d* of the first frame portion 41 is made up of the three side wall pieces 41*e*, 41*f* and 41*g*. Of the three side wall pieces 41*e*, 41*f* and 41*g*, the side wall piece 41*e* rises up from an end portion of the second opposing wall 41*b*. In addition, the side wall piece 41*f* extends downward from an end portion of the first opposing wall 41*a* to be put on top of the side wall piece 41*e*. Thus, a gapless frame structure is formed in the abutment portion 50. In addition, the side wall piece 41*g* is positionally displaced from the side wall piece 41*e* in the insertion direction of the contact flat plate portion 210 (a direction of an arrow X1 in FIG. 4) and rises up from the end portion of the second opposing wall 41*b*. As shown in FIG. 4 and FIG. 6, a side edge S1 positioned on a front side of the side wall portion 41*g* in the insertion direction of the contact flat plate portion 210 abuts against a side edge S2 positioned on a back side of the side wall piece 41*f* in the insertion direction of the contact flat plate portion 210, so that the side wall piece 41*f* can be restricted from moving in the direction of the arrow X1.

<Second Frame Portion 42>

The second frame portion 42 is formed into a tetragonal shape which internally touches a rear end portion 31*b* (see FIG. 3(A)) of the terminal fitting portion 31. As shown in FIG. 3(B), the second frame portion 42 includes a first opposing wall 42*a*, a second opposing wall 42*b*, a side wall portion 42*c* and a side wall portion 42*d* which form a tetragonal frame. The first opposing wall 42*a* is opposed to the one surface 211 of the contact flat plate portion 210 inserted into the terminal fitting portion 31. The second opposing wall 42*b* is opposed to the other surface 212 of the contact flat plate portion 210. The side wall portion 42*c* connects the first opposing wall 42*a* and the second opposing wall 42*b* to each other. The side wall portion 42*d* includes three side wall pieces 42*e*, 42*f* and 42*g*.

As shown in FIG. 4, the one side wall portion 42*d* of the second frame portion 42 is made up of the three side wall pieces 42*e*, 42*f* and 42*g*. Of the three side wall pieces 42*e*, 42*f* and 42*g*, the side wall piece 42*e* rises up from an end portion of the second opposing wall 42*b*. In addition, the side wall piece 42*f* extends downward from an end portion of the first opposing wall 42*a* to be put on top of the side wall piece 42*e*. Thus, a gapless frame structure is formed in an abutment portion 50. In addition, the side wall piece 42*g* is positionally displaced from the side wall piece 42*e* in an opposition direction (a direction of an arrow X2 in FIG. 4) to the insertion direction of the contact flat plate portion 210 and rises up from the end portion of the second opposing wall 42*b*. As shown in FIG. 4, a side edge S3 positioned on a back side of the side wall piece 42*g* in the insertion direction of the contact flat plate portion 210 abuts against a side edge S4 positioned on a front side of the side wall piece 42*f* in the insertion direction of the contact flat plate portion 210, so that the side wall piece 42*f* can be restricted from moving in the direction of the arrow X2.

As shown in FIG. 5, a slip-out stopping piece 42*h* is protrusively provided in the second opposing wall 42*b* of the second frame portion 42 according to the embodiment. The slip-out stopping piece 42*h* is fitted into a lock hole 34 formed in the terminal fitting portion 31 to restrict the spring contact 40 from moving in a slip-out direction (a direction of an arrow Z3 in FIG. 5).

As the slip-out stopping piece 42*h*, a plate piece extending from a rear end of the second opposing wall 42*b* is bent downward. As shown in FIG. 5, the lock hole 34 into which the slip-out stopping piece 42*h* is fitted is set so that a length L of the lock hole 34 in the insertion direction of the contact flat plate portion 210 is larger than a plate thickness t of the slip-out stopping piece 42*h*. The length L of the lock hole 34 is set as a length including a margin so that the slip-out stopping piece 42*h* can be prevented from hitting against the lock hole 34 when the first long plate spring pieces 43 and the second long plate spring pieces 44 extend due to the insertion of the contact flat plate portion 210 and the second opposing wall 42*b* moves in the insertion direction of the contact flat plate portion 210 accordingly. For example, the length L of the lock hole 34 is set as a length which is not lower than the sum of the plate thickness of the slip-out stopping piece 42*h* and the length of extension of the second long plate spring piece 44.

<<Engagement Structure Between Side Wall Pieces in Abutment Portions 50 of First Frame Portion 41 and Second Frame Portion 42>>

The side edge S2 positioned on the back side of the side wall piece 41*f* in the insertion direction of the contact flat plate portion 210 abuts against the side edge S1 positioned on the front side of the side wall piece 41*g* in the insertion direction of the contact flat plate portion 210. The side wall piece 41*f* extends from the first opposing wall 41*a* of the first frame portion 41. The side wall piece 41*g* extends from the second opposing wall 41*b* of the first frame portion 41. In this manner, the side wall piece 41*f* can be restricted from moving in the direction of the arrow X1 in FIG. 4.

Further, the side edge S4 positioned on the front side of the side wall piece 42*f* in the insertion direction of the contact flat plate portion 210 abuts against the side edge S3 positioned on the deep side of the side wall piece 42*g* in the insertion direction of the contact flat plate portion 210. The side wall piece 42*f* extends from the first opposing wall 42*a* of the second frame portion 42. The side wall piece 42*g* extends from the second opposing wall 42*b* of the second frame portion 42. In this manner, the side wall piece 42*f* can be restricted from moving in the direction of the arrow X2 in FIG. 4.

That is, the abutment between the side wall piece 41*f* and the side wall piece 41*g* and the abutment between the side wall piece 42*f* and the side wall piece 42*g* restrict the side wall pieces 41*f*, 42*f*, 41*g* and 42*g* from moving relatively to each other in the direction along the insertion direction of the contact flat plate portion 210. Thus, a friction force acting on the spring contact 40 during insertion/removal of the contact flat plate portion 210 can prevent positional displacement from occurring on the side of the abutment portions 50.

<<Height H3 of Side Wall Portion 41*c*, 42*c*>>

In the case of the spring contact 40 according to the embodiment, the side wall portion 41*c* of the first frame portion 41 and the side wall portion 42*c* of the second frame portion 42 are set so that a height H3 (see FIG. 3(B)) of each side wall portion 41*c*, 42*c* in the plate thickness direction of the contact flat plate portion 210 is larger than a corresponding inner height H4 (see FIG. 3(A)) of the terminal fitting portion 31. In addition, in the case of the embodiment, each of the side wall portion 41*c* and the side wall portion 42*c* is provided with a curved shape portion R which can expand/contract the side wall portion 41*c*, 42*c* in the height direction. The curved shape portion R according to the embodiment is formed in such a manner that the whole of the side wall portion 41*c*, 42*c* is curved outward into a convex circular arc shape.

<<First Long Plate Spring Piece 43>>

The first long plate spring pieces 43 are plate springs which are laid between the first opposing wall 41*a* of the first frame portion 41 and the first opposing wall 42*a* of the second frame portion 42 to make elastic contact with the one surface 211 of the contact flat plate portion 210. The first long plate spring pieces 43 are provided and arranged in parallel with one another. In side view, as shown in FIGS. 5 to 8, each of the first long plate spring pieces 43 is formed into a convex circular arc shape toward the side of the surface 211 of the contact flat plate portion 210, and an intermediate portion of the first long plate spring piece 43 as the vertex of the circular arc makes contact with the surface 211 of the contact flat plate portion 210.

<<Second Long Plate Spring Piece 44>>

The second long plate spring pieces 44 are plate springs which are laid between the second opposing wall 41*b* of the first frame portion 41 and the second opposing wall 42*b* of the second frame portion 42 to make elastic contact with the other surface 212 of the contact flat plate portion 210. The second long plate spring pieces 44 are provided and arranged in parallel with one another. In side view, as shown in FIGS. 5 to 8, each of the second long plate spring pieces 44 is formed into a convex circular arc shape toward the side of the surface 212 of the contact flat plate portion 210, and an intermediate portion of the second long plate spring piece 44 as the vertex of the circular arc makes contact with the surface 212 of the contact flat plate portion 210.

In the case of the aforementioned female terminal assembly 20 according to the second embodiment, when the spring contact 40 is fitted into the terminal fitting portion 31 of the female terminal body 30, the height H3 of each of the side wall portions 41*c* and 42*c* of the first and second frame portions 41 and 42 of the spring contact 40 is set to be larger than the corresponding inner height H4 of the terminal fitting portion 31. Accordingly, the side wall portions 41*c* and 42*c* of the first and second frame portions 41 and 42 can be elastically deformed in a height reduction direction due to deflection of the curved shape portions R. Due to the elastic deformation of the side wall portions 41*c* and 42*c*, the first opposing walls 41*a* and 42*a* and the second opposing walls 42*a* and 42*b* connected by the side wall portions 41*c* and 42*c* are brought into pressure contact with opposing inner wall surfaces of the terminal fitting portion 31 by restoration forces of the curved shape portions R. Thus, the spring contact 40 and the female terminal body 30 are connected to each other electrically conductively.

High contact pressure can be secured in contact portions between the spring contact 40 and the female terminal body 30 which are brought into pressure contact with each other due to the deflection of the curved shape portions R of the side wall portions 41*c* and 42*c*, for example, in comparison with the case where free ends of cantilever-like plate springs are brought into contact.

Therefore, it is possible to make an electric connection state between the spring contact 40 and the female terminal body 30 stable. When the electric connection state between the spring contact 40 and the female terminal body 30 is made stable, stable electric properties can be secured.

In addition, in the case of the female terminal assembly 20 according to the second embodiment, assume that the contact flat plate portion 210 of the male terminal is inserted into the spring contact 40 in the terminal fitting portion 31 of the female terminal body 30 and the spring contact 40 is pressed in the insertion direction by the contact flat plate portion 210, as shown in FIG. 7 and FIG. 8. In this case, the spring contact 40 extends rearward because the spring contact 40 is free on the spring rear end side with the bent portions 41*h* (which are lock portions) as fixed points. Accordingly, the spring extension direction and the insertion direction are the same. Therefore, the force for inserting the terminal tends to decrease so that the male terminal can be connected to the female terminal assembly 20 by a small insertion force.

Accordingly, it is not necessary to provide a low insertion force lever in the connector for the purpose of reducing an operation force. Thus, omission of the low insertion force level can result in reduction of manufacturing cost of the connector.

In addition, in the case of the aforementioned female terminal assembly 20 according to the second embodiment, the spring contact 40 has the following structure. That is, since the abutment portions 50 are set on one side surface side of the spring contact 40, the first opposing walls 41*a* and 42*a* and the second opposing walls 41*b* and 42*b* connected by the other side wall portions 41*c* and 42*c* having the curved shape portions R are symmetric to each other respectively. Therefore, the elastic restoration forces of the curved shape portions R can be applied to the first opposing walls 41*a* and 42*a* and the second opposing walls 41*b* and 42*b* uniformly. Accordingly, the electric connection state between the spring contact 40 and the female terminal body 30 can be made more stable.

Moreover, in the case of the aforementioned female terminal assembly 20 according to the second embodiment, assume that the contact flat plate portion 210 of the male terminal is inserted/removed between the first long plate spring pieces 43 and the second long plate spring pieces 44 of the spring contact 40. In this case, the side wall pieces 41*f* and 42*f* extending from the first opposing walls 41*a* and 42*a* abut against the side wall pieces 41*g* and 42*g* extending from the second opposing walls 41*b* and 42*b* in the one side wall portions 41*d* and 42*d* serving as the abutment portions 50 of the spring contact 40 so that the side wall pieces 41*f* and 42*f* and the side wall pieces 41*g* and 42*g* can be restricted from moving relatively to each other respectively in the direction along the insertion direction of the contact flat plate portion 210. Thus, it is possible to prevent distortion from being generated on one side of the spring contact 40.

Therefore, a work for inserting/removing the contact flat plate portion 210 can be prevented from being impeded by the distortion of the spring contact 40 during insertion/removal of the contact flat plate portion 210 of the male terminal. Thus, it is possible to easily perform the work for inserting/removing the contact flat plate portion 210.

Moreover, in the case of the aforementioned female terminal assembly 20 according to the second embodiment, the engagement structure between each side wall piece 41*f*, 42*f* and each side wall piece 41*g*, 42*g* for restricting the side wall piece 41*f*, 42*f* and the side wall piece 41*g*, 42*g* from moving relatively to each other in the direction along the insertion direction of the contact flat plate portion 210 is a simple engagement structure which can bring the outer side edges into abutment against each other. Therefore, it is possible to prevent the structure of the spring contact 40 from being complicated for provision of the side wall piece 41*f*, 42*f* and the side wall piece 41*g*, 42*g*, for example, in comparison with the case where the side wall piece 41*f*, 42*f* and the side wall piece 41*g*, 42*g* which have convex and concave structures respectively are engaged with each other by fitting the convex and concave structures to each other. Thus, it is possible to easily manufacture the spring contact 40.

Moreover, in the case of the aforementioned female terminal assembly 20 according to the second embodiment, when the spring contact 40 is mounted in the terminal fitting portion 31 of the female terminal body 30, the slip-out stopping piece 42*h* provided protrusively in the second opposing wall 41*b* of the second frame portion 42 of the spring contact 40 is fitted into the lock hole 34 formed in the terminal fitting portion 31 so that the spring contact 40 can be prevented from slipping out of the terminal fitting portion 31. Therefore, even when the contact flat plate portion 210 of the male terminal is removed from the terminal fitting portion 31 with the result that a force in a removal direction acts on the spring contact 40, the spring contact 40 can be prevented from being removed together with the male terminal from the terminal fitting portion 31 so that it is possible to easily perform an operation for inserting/removing (an operation for removing) the male terminal.

As described above, the lock portions formed at the male terminal insertion-side end portions of the spring contact are fixed between the end portion of the female terminal body and the resin cap. Accordingly, when the male terminal is inserted into the female terminal assembly to press the spring contact, the spring contact extends rearward because the spring contact is free on the spring rear end side with the lock portions as fixed points. Accordingly, the spring extension direction and the insertion direction are the same. Therefore, the force for inserting the terminal decreases.

As a result, it is possible to obtain a female terminal assembly in which an insertion force can be reduced without providing any low insertion force lever in a connector so that it is possible to contribute to miniaturization of the connector itself and further meet market needs for multipolarization of a terminal.

Incidentally, the invention is not limited to the aforementioned embodiments but may be carried out with modification, improvement, etc. made thereon suitably. In addition thereto, the materials, the shapes, the dimensions, the numbers, the arrangement places etc. of the respective constituent elements in the aforementioned embodiments are not limited but may be set desirably as long as the invention can be achieved.

For example, the embodiment has been carried out on the assumption that the lock portions are provided as the bent portions which are formed by bending the end portions of the spring contact outwards. However, the invention is not limited thereto. The lock portions may be provided as convex portions which are formed in the end portions of the spring contact to protrude outward or provided as screws which are inserted and fixed into the end portions of the spring contact from the outside.

The spring contact shaped like a circular cylinder and the spring contact shaped like a rectangular cylinder (rectangle) have been used by way of example in the above description. However, the invention is not limited to the spring contact shaped like a circular cylinder and the spring contact shaped like a rectangular cylinder (rectangle). Alternatively, the spring contact may have any shape as long as the shape of entrance into which the male terminal is inserted is shaped like a cylinder such as an ellipse or a polygon.

Here, the aforementioned characteristics of the embodiments of the female terminal assembly according to the invention will be summarized briefly in the following paragraphs [1] to [9].

[1]A female terminal assembly (10) comprising: a female terminal body (11) in which a male terminal receiving space is formed internally; and a cylindrical spring contact (13) which is received in the male terminal receiving space from a male terminal insertion side of the female terminal body (11), wherein lock portions formed at male terminal insertion-side end portions of the spring contact (13) are fixed to male terminal insertion-side end portions of the female terminal body (11).

[2] The female terminal assembly (10) according to the aforementioned paragraph [1], wherein the lock portions are provided as bent portions (13S) which are formed by bending end portions of the spring contact (40) outward.

[3] The female terminal assembly (10) according to the aforementioned paragraph [2], wherein spring bent portion locking notches (11S) are formed at the end portions of the female terminal body (11), and the bent portions (13S) of the spring contact (13) are locked to the spring bent portion locking notches.

[4] The female terminal assembly (10) according to any one of the aforementioned paragraphs [1] to [3], wherein the cylindrical spring contact is a circular cylindrical spring contact (13).

[5] The female terminal assembly (10) according to the aforementioned paragraph [4], further including: a resin cap (12) which is fitted to an end portion of the female terminal body (11), wherein the lock portions are fixed between the end portion of the female terminal body (11) and the resin cap (12).

[6] The female terminal assembly (20) according to any one of the aforementioned paragraphs [1] to [3], wherein the cylindrical spring contact is a rectangular cylindrical spring contact (40).

[7] The female terminal assembly (20) according to the aforementioned paragraph [6], wherein a slip-out stopping piece (42*h*) is protrusively provided in the rectangular cylindrical spring contact (40) so that the slip-out stopping piece (42*h*) is fitted to a lock hole (34) formed in the female terminal body (11) to restrict the rectangular cylindrical spring contact (40) from moving in a slip-out direction.

[8] The female terminal assembly (20) according to the aforementioned paragraph [7], wherein the rectangular cylindrical spring contact (40) is formed by bending a metal plate into a rectangular cylindrical shape so that abutment portions (50) between end edges of the metal plate bent into the rectangular cylindrical shape are formed on one side surface side of the rectangular cylindrical spring contact (40), and side wall portions (41*c*, 42*c*) having curved shape portions R are formed on the other side surface side of the rectangular cylindrical spring contact (40).

[9] The female terminal assembly (20) according to the aforementioned paragraph [8], wherein side edges (S2, S4) of side wall pieces (41*f*, 42*f*) extending from one end edges and side edges (S1, S3) of side wall pieces (41*g*, 42*g*) extending from the other end edges abut against each other respectively in the abutment portions (50) of the rectangular cylindrical spring contact (40), so that the abutment between the side edges of the side wall pieces restricts the side wall pieces from moving relatively to each other in a direction along an insertion direction of a male terminal.

Although the invention has been described in detail and with reference to the specific embodiments, it is obvious to those skilled in the art that various changes or modifications may be made on the invention without departing from the spirit and scope of the invention.

According to the invention, it is possible to obtain an effect that an insertion force can be reduced without providing any low insertion force lever in a connector so that it is possible to contribute to miniaturization of the connector itself and further meet market needs for multipolarization of a terminal. The invention which can obtain the effect is useful for a female terminal assembly of a connector housing used for connection etc. between a battery of an electric car and various equipments.

What is claimed is:

1. A female terminal assembly comprising:

a female terminal body in which a male terminal receiving space is formed internally; and a cylindrical spring contact which is received in the male terminal receiving space from a male terminal insertion side of the female terminal body, wherein a lock portion formed at a male terminal insertion-side end portion of the spring contact is fixed to a male terminal insertion-side end portion of the female terminal body, wherein the cylindrical spring contact is a rectangular cylindrical spring contact, and wherein the rectangular cylindrical spring contact is formed by bending a metal plate into a rectangular cylindrical shape so that an abutment portion between end edges of the metal plate bent into the rectangular cylindrical shape is formed on one side surface side of the rectangular cylindrical spring contact, and a side wall portion having a curved shape portion is formed on the other side surface side of the rectangular cylindrical spring contact.

2. The female terminal assembly according to claim 1, wherein the lock portion is a bent portion which is formed by bending an end portion of the spring contact outward.

3. The female terminal assembly according to claim 2, wherein a spring bent portion locking notch is formed at the end portion of the female terminal body, and the bent portion of the spring contact is locked to the spring bent portion locking notch.

4. The female terminal assembly according to claim 1, wherein a slip-out stopping piece is protrusively provided in the rectangular cylindrical spring contact so that the slip-out stopping piece is fitted to a lock hole formed in the female terminal body to restrict the rectangular cylindrical spring contact from moving in a slip-out direction.

5. The female terminal assembly according to claim 1, wherein a side edge of a side wall piece extending from one end edge and a side edge of a side wall piece extending from the other end edge abut against each other in the abutment portion of the rectangular cylindrical spring contact, so that the abutment between the side edges of the side wall pieces restricts the side wall pieces from moving relatively to each other in a direction along an insertion direction of a male terminal.

* * * * *